US007216629B2

(12) United States Patent
Baranowski et al.

(10) Patent No.: US 7,216,629 B2
(45) Date of Patent: May 15, 2007

(54) HIGH-PRESSURE INJECTION SYSTEM WITH A CONTROL THROTTLE EMBODIED AS A CASCADE THROTTLE

(75) Inventors: Dirk Baranowski, Regensburg (DE); Wendelin Klügl, Seubersdorf (DE); Michael Von Dirke, Thalmassing (DE)

(73) Assignee: Siemens Aktiengesellschaft, Munich (DE)

( * ) Notice: Subject to any disclaimer, the term of this patent is extended or adjusted under 35 U.S.C. 154(b) by 624 days.

(21) Appl. No.: 10/465,301

(22) Filed: Jun. 19, 2003

(65) Prior Publication Data

US 2004/0035950 A1 Feb. 26, 2004

Related U.S. Application Data

(63) Continuation of application No. PCT/DE01/04703, filed on Dec. 13, 2001.

(30) Foreign Application Priority Data

Dec. 20, 2000 (DE) ..... 100 63 698

(51) Int. Cl.
*F02M 37/04* (2006.01)

(52) U.S. Cl. ..... 123/467; 123/447

(58) Field of Classification Search ..... 123/467, 123/446, 500, 501, 456, 299, 300
See application file for complete search history.

(56) References Cited

U.S. PATENT DOCUMENTS

| | | | | |
|---|---|---|---|---|
| 4,118,156 A | | 10/1978 | Ivosevic | 417/494 |
| 4,526,151 A | | 7/1985 | Tateishi et al. | 123/468 |
| 5,890,471 A | * | 4/1999 | Nishimura | 123/496 |
| 6,401,691 B1 | * | 6/2002 | Kawano et al. | 123/456 |
| 6,439,193 B2 | * | 8/2002 | Lehtonen | 123/299 |
| 6,520,152 B1 | * | 2/2003 | Mahr et al. | 123/447 |
| 6,725,840 B1 | * | 4/2004 | Mahr et al. | 123/467 |
| 6,877,483 B2 | * | 4/2005 | Askew | 123/467 |

FOREIGN PATENT DOCUMENTS

| | | | |
|---|---|---|---|
| DE | 29518547 U1 | | 2/1996 |
| EP | 0743460 A1 | | 11/1996 |
| EP | 0743478 A1 | | 11/1996 |
| EP | 09769242 A2 | | 2/2000 |
| WO | 01/14712 | * | 3/2001 |
| WO | 02/50423 A1 | | 6/2002 |

OTHER PUBLICATIONS

PCT International Search Report PCT/DE01/04703 (Translation) 5pages, Sep. 23, 2002.

* cited by examiner

*Primary Examiner*—Carl S. Miller
(74) *Attorney, Agent, or Firm*—Baker Botts L.L.P.

(57) ABSTRACT

A high pressure injection system comprises at least one fuel high pressure accumulator, a control chamber and a valve, in addition to an injection valve having a valve needle and a control piston. The control chamber is connected to the high pressure accumulator by means of an inlet throttle and to the valve by means of an outlet throttle. The control chamber controls the movement of the control piston and the valve needle connected thereto. To this end, flow conditions of the fuel flowing into and out of the control chamber are regulated by means of the inlet throttle and the outlet throttle. The inlet throttle is configured as a multi-stage throttle.

13 Claims, 2 Drawing Sheets

HIGH-PRESSURE INJECTION SYSTEM WITH A CONTROL THROTTLE EMBODIED AS A CASCADE THROTTLE

CROSS-REFERENCE TO RELATED APPLICATION

This application is a continuation of co-pending International Application No. PCT/DE01/04703 filed Dec. 13, 2001 which designates the United States, and claims priority to German application number DE10063698.5 filed Dec. 20, 2000.

TECHNICAL FIELD OF THE INVENTION

The invention relates to a high-pressure injection system with a control throttle embodied as a cascade throttle and especially a high-pressure injection system of the type used in common rail injection systems of a direct injection diesel engine.

BACKGROUND OF THE INVENTION

High-pressure accumulator injection systems, also known as common rail injection systems, are distinguished from conventional injection systems in that the injection pressure can be generated independent of the engine speed. The decoupling of the pressure generation and injection is achieved with the aid of an accumulator, in which fuel is stored under high pressure. The high pressure in the accumulator is created by means of a high-pressure pump. Fuel from the accumulator is used to supply an injection valve and also a control chamber, by means of which a valve needle of the injection valve is controlled. A control piston is also fitted in the control chamber in such a way that it can slide, with one end of the piston being connected to the valve needle and pressure being applied to its other end in the control chamber. The pressure in the control chamber is supplied from the pressure in the accumulator via a connecting line. The control chamber is connected to a valve to release the pressure. Furthermore, an inlet throttle is positioned between the accumulator and control chamber and an outlet throttle between the control chamber and valve to guarantee a predetermined pressure build-up or reduction in the control chamber after the closing or opening of the valve respectively.

The outlet throttle is designed so that the cavitation transition point, i.e. the backpressure, which if undershot means that the flow through the throttle can no longer be increased due to cavitation and therefore a backpressure is felt downstream of the throttle regardless of the direction of flow, is as high as possible. This causes cavitation to occur at the outlet throttle with the valve open (low backpressure) and flow through the throttle, and thus movement of the control piston becomes independent of the cross-sectional area of flow of the valve.

The predetermined pressure build-up/pressure reduction in the control chamber creates a controlled movement of the control piston and the valve needle connected to it. Controlled in this case means that the time point of the start of movement when opening and closing, and also the speed of movement itself, can be predetermined by the size of the cross-sectional areas of the control piston and valve needle to which pressure is admitted as well as by the fuel pressure in the accumulator and the flow characteristics of the throttles, particularly flow resistance and cavitation point. The reproducible injection of defined amounts of fuel with high precision thus demands a high degree of accuracy in the manufacture of control pistons and throttles. The relatively large cross-sectional areas of control pistons can be very accurately manufactured but the production of throttles with low production tolerances on the other hand demands very high expenditure, as explained in the following.

The throttles used for injection devices according to the prior art are in the form of cylindrical cross-sectional convergences in the flow path between the control chamber and accumulator or between the control chamber and valve. Such conventional throttles typically have a length of approximately 1 mm and a typical throttle passage diameter of 0.3 mm. The throttle passage is, for example, produced by drilling or by electrochemical erosion. The length of the throttle itself is of minor significance with regard to the flow properties of the throttle. The flow properties of the throttles are, however, not only determined by the diameter of the throttle passage, but also by any taper, the shape of inlet and outlet edges and the surface finish of the throttle passage. The setting of the flow resistance, that determines the function of the throttle, to the set value is achieved by rounding the inlet edges using hydroerosion. Throttles with fine tolerances and uniform quality with regard to flow parameters can thus be produced only at high cost. In practice, the throttle manufacturer must also take account of a correspondingly high rejection rate.

SUMMARY OF THE INVENTION

In contrast, the object of the invention is to reduce the technical production cost of the manufacture of accumulator injection systems, particularly with regard to throttles.

To achieve this object, an accumulator injection device may comprise at least one high-pressure accumulator, a control chamber with a control piston, a valve, and an injection valve with a valve needle, with the injection valve being controlled by means of the control chamber and control piston, and the control chamber being connected to the high-pressure accumulator via an inlet throttle and also to the valve via an outlet throttle, wherein the inlet throttle is configured as a multistage throttle.

An accumulator injection system may also comprise at least one high-pressure accumulator, a valve, a control chamber with a control piston, being connected to the high-pressure accumulator via a multistage inlet throttle and being connected to the valve via an outlet throttle, and an injection valve with a valve needle, controlled by the control chamber and the control piston.

The inlet throttle can be a cascade throttle or may be constructed from a number of similar single throttles and/or throttle elements. The single throttles or throttle elements of the multistage inlet throttle can be aligned relative to each other in such a way that their throttle passages are offset relative to each other. The multistage inlet throttle may include disk-shaped throttle elements with groove-shaped throttle passages, arranged in a housing in the manner of a series circuit. Spacers may be provided between the throttle elements.

A method of operating an accumulator injection system with at least one high-pressure accumulator, a valve, a control chamber with a control piston, and an injection valve with a valve needle, may comprise the step of controlling the injection valve by the control chamber and the control piston through the high-pressure accumulator via a multistage inlet throttle.

The method may further comprise the step of constructing the multistage inlet throttle from a number of similar single throttles and/or throttle elements. The method may also comprise the step of aligning the single throttles or throttle elements of the multistage inlet throttle relative to each other in such a way that their throttle passages are offset relative to each other.

Accordingly, the inlet throttle of an accumulator injection system is embodied as a multistage throttle. The construction of the inlet throttle in the form of several throttle stages, or of throttles arranged in series, enables greater manufacturing tolerances in the production of individual throttles or throttle stages, without the flow characteristics of an inlet throttle constructed in this way being impaired. The requirements regarding the manufacturing tolerances of a single throttle stage, or of throttles, and thus of the inlet throttle itself are substantially reduced, thus achieving a lower production cost in the manufacture of the accumulator injection device in accordance with the invention.

The lower requirements regarding the manufacturing tolerance of the multistage throttle are obtained due to the following: the scatter of a flow-through due to the manufacturing tolerance of a flow cross-section is calculated according to the formula $$\Delta Q = \frac{\Delta A}{A} \cdot Q,$$

with A being the cross-sectional area, ΔA the manufacturing tolerance, Q the flow-through and ΔQ the scatter of the flow-through Q. The total flow cross-section $A_{total}$ of a multistage throttle is calculated from the flow cross-section A of inlet throttles using $$A_{total} = \sqrt{N} \cdot A,$$

with N being the number of single throttles. The single throttles of an inlet throttle with N stages thus has a flow cross-section that is increased by the factor $\sqrt{N}$ compared to an inlet throttle designed as a single throttle. The scatter ΔQ of the flow-through Q for a multistage throttle is calculated according to the following $$\Delta Q = \frac{1}{N} \cdot \frac{\Delta A}{A} \cdot Q.$$

The scatter of the flow-through of a throttle with N stages thus drops to the Nth part of the value of an inlet throttle designed as a single throttle.

When manufacturing accumulator injection devices according to the invention, single throttles which on the one hand have a higher flow cross-section and on the other hand have a larger manufacturing tolerance can be used by designing the inlet throttle as a multistage throttle. The manufacturing cost can thus be reduced compared with injection systems using inlet throttles according to prior art.

The multistage design of inlet throttles also reduces, in an advantageous manner, the pressure drop at the single throttle stages. At a total pressure drop of $\Delta P_{total}$ the pressure drop at the first throttle stage is obtained as $$\Delta P_1 = \frac{1}{N} \cdot \Delta P_{total}$$

and at the Nth throttle stage as $$\Delta P_N = \frac{2}{N+1} \cdot \Delta P_{total}.$$

With a three-stage throttle, the pressure drop of the throttle stages is between 17% and 25% of the total pressure drop, and for a ten-stage throttle is already between only 5% and 9% of the total pressure drop. This means that cavitation in the inlet throttle can be largely avoided in an advantageous manner.

With one advantageous embodiment of the invention, the inlet throttle is designed as a separate cascade throttle. A design of this kind assists the compact construction of the accumulator injection device. The design of the multistage throttle as a separate, installable component in the form of a cascade throttle furthermore assists the handling and installation of the throttle during the production process.

With a preferred development of the invention, the inlet throttle is constructed from a number of similar single throttles or throttle elements. The use of similar single throttles or throttle elements enables production to be rationalized. Furthermore, the flow cross-section of a single throttle or throttle element can be chosen so that different total cross-sections of the inlet throttle, that for example can occur where there are different types of accumulator injection devices, can be realized simply by varying the number of single throttles or throttle elements. A modular inlet throttle construction of this kind reduces the number of different components and achieves a greater adjustability with regard to flow resistance.

With a further advantageous embodiment, the single throttles or throttle elements are aligned relative to each other in such a way that their throttle passages are offset relative to each other. This means that the throttling effect of a throttle or single throttle element is substantially uninfluenced by the action of the other throttles or throttle elements. The flow properties of multistage throttles can thus be more accurately predicted and unwanted or unforeseen interactions between the throttle elements can be largely eliminated.

Further advantages and configurations of the invention are explained in the description and the accompanying drawing.

It is understood that the features named in the aforementioned and explained in the following can be used not only in the particular combination given but also in other combinations or alone, without departing from the framework of this invention.

BRIEF DESCRIPTION OF THE DRAWING

The invention is schematically illustrated by a drawing showing an exemplary embodiment and is described in detail in the following with reference to the drawings. These are as follows.

DETAILED DESCRIPTION OF THE PREFERRED EMBODIMENTS

Figure 1:
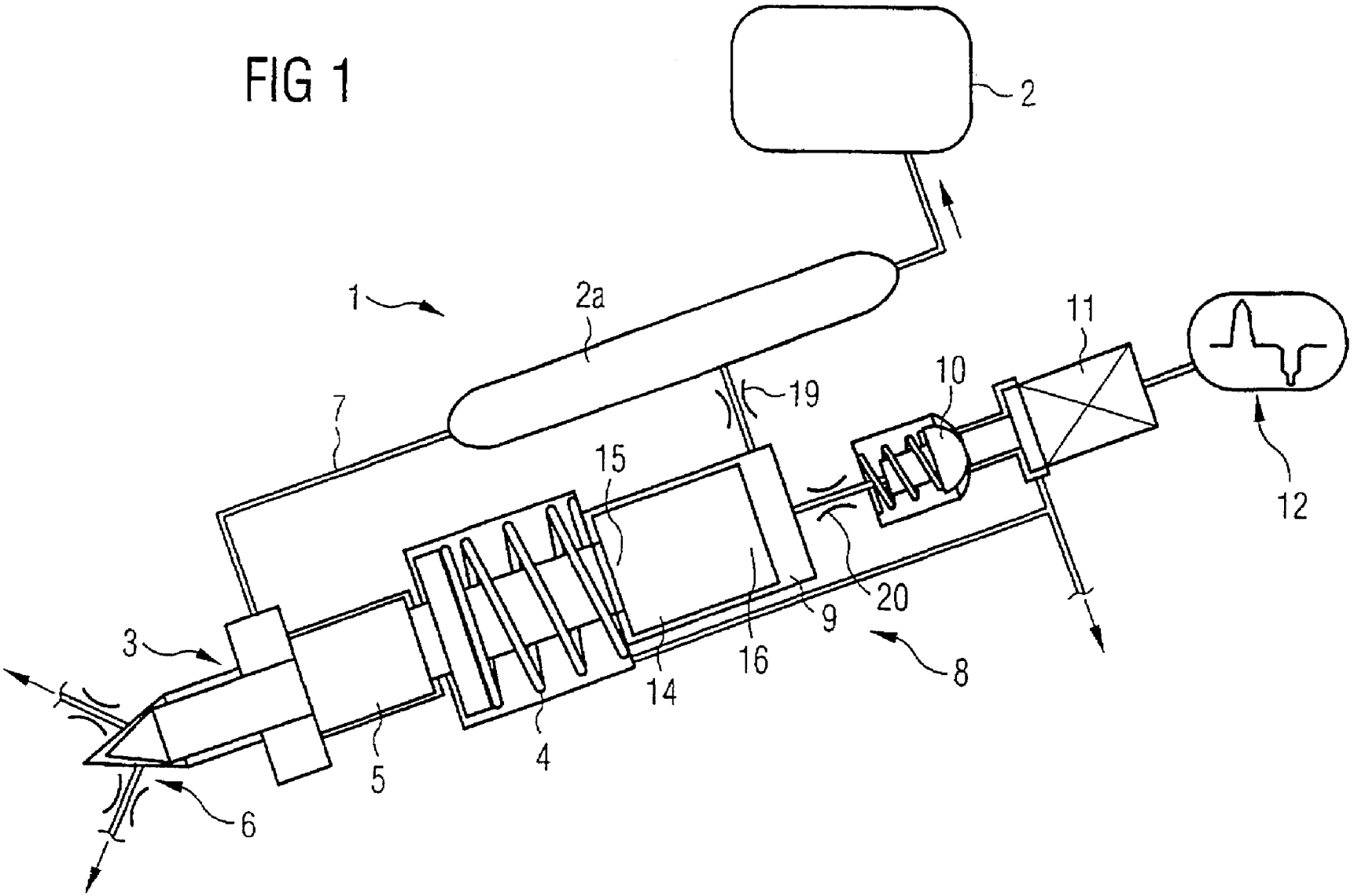
FIG. 1 A schematic representation of an accumulator injection device in accordance with the invention.

FIG. 1 is a schematic showing an accumulator injection device 1 in accordance with the invention that, for example, is constructed in the manner of a common rail injection system with a 2/2-way Piezo valve. The accumulator injection device 1 comprises a high-pressure accumulator 2*a*, a high-pressure line 2, an injection valve 3 and a means 8 for hydraulic control of the injection valve 3. As a control means 8, a control chamber 9 is provided that is connected to the high-pressure accumulator 2*a* by a high-pressure line 2, as well as a valve 10 that is also connected to the control chamber. The valve 10 is actuated via a Piezo actuator 11. Reference 12 is a schematic view of the electronic control of the Piezo actuator 11.

A control piston 14 is fitted in the control chamber 9 so as to be slidable. The pressure of the control chamber 9 is admitted to one end 15 of the control piston 14 and the other end 16 acts on a valve needle 5 of the injection valve 3. The valve needle 5 is moveably mounted in the injection valve 3, to open or close the nozzle openings 6 of the injection valve 3. The valve needle 6 is held by the pressure of a spring 7 against the valve seat of the injection valve 3. The injection valve 3 is supplied with fuel from the high-pressure accumulator 2*a* by a supply line 7.

Throttles 19, 20 are provided in each case between the control chamber 9 and the high-pressure accumulator 2*a* and between the control chamber 9 and valve 10, through which throttles fuel from the high-pressure accumulator 2*a* can flow into the control chamber 9 and out of the control chamber 9. The throttles 19, 20 enable predetermined flow parameters of the fuel flow into and out of the control chamber 9 to be set. The inlet throttle 19 is constructed as a multistage throttle in accordance with the invention.

With the valve 10 closed, fuel flows from the high-pressure accumulator 2*a* and the high-pressure line 2 via the inlet throttle 19 to the control chamber 9. Thus, a fuel pressure corresponding to the high-pressure accumulator 2*a* builds up in the control chamber 9 and the pressure of the control chamber 9 is felt on the control piston 14 at its control piston end 16. This causes a movement of the control piston 14 in the direction of the nozzle openings 6 of the injection valve 3 that is transmitted to the valve needle 5 through the valve needle end 15 of the control piston 14. The valve needle 5 closes the nozzle openings 6 of the injection valve 3 against the pressure of the fuel to be injected. After the valve 10 opens, fuel from the control chamber 9 can flow more quickly from the control chamber 9 via the outlet throttle 20 than fuel supplied from the high-pressure accumulator 2*a* can flow back via the inlet throttle 19. By suitably chosen flow resistances of the inlet and outlet throttles 19, 20, a controlled movement of the control piston 14 in the direction of the valve 10 and thus a controlled lift of the valve needle 5 from the valve seat of the injection valve 3 is guaranteed. Fuel from the high-pressure accumulator 2*a* is injected through the nozzle openings 6 cleared by the valve needle 5. After the valve 10 closes, the pressure in the control chamber 9 is again built up by fuel flowing through the inlet throttle 19. This causes the valve needle 5 to move onto the valve seat of the injection valve 3 under the control of the control piston 14 and the nozzle openings 6 are closed. The precise timing of the opening and closing of the injection valve is guaranteed by a precise setting of the flow conditions at the inlet and outlet throttles. The configuration according to the invention of the inlet throttle 19 as a multistage throttle guarantees sufficient adjustment accuracy of the flow resistance at a reduced production cost.

Figure 2:
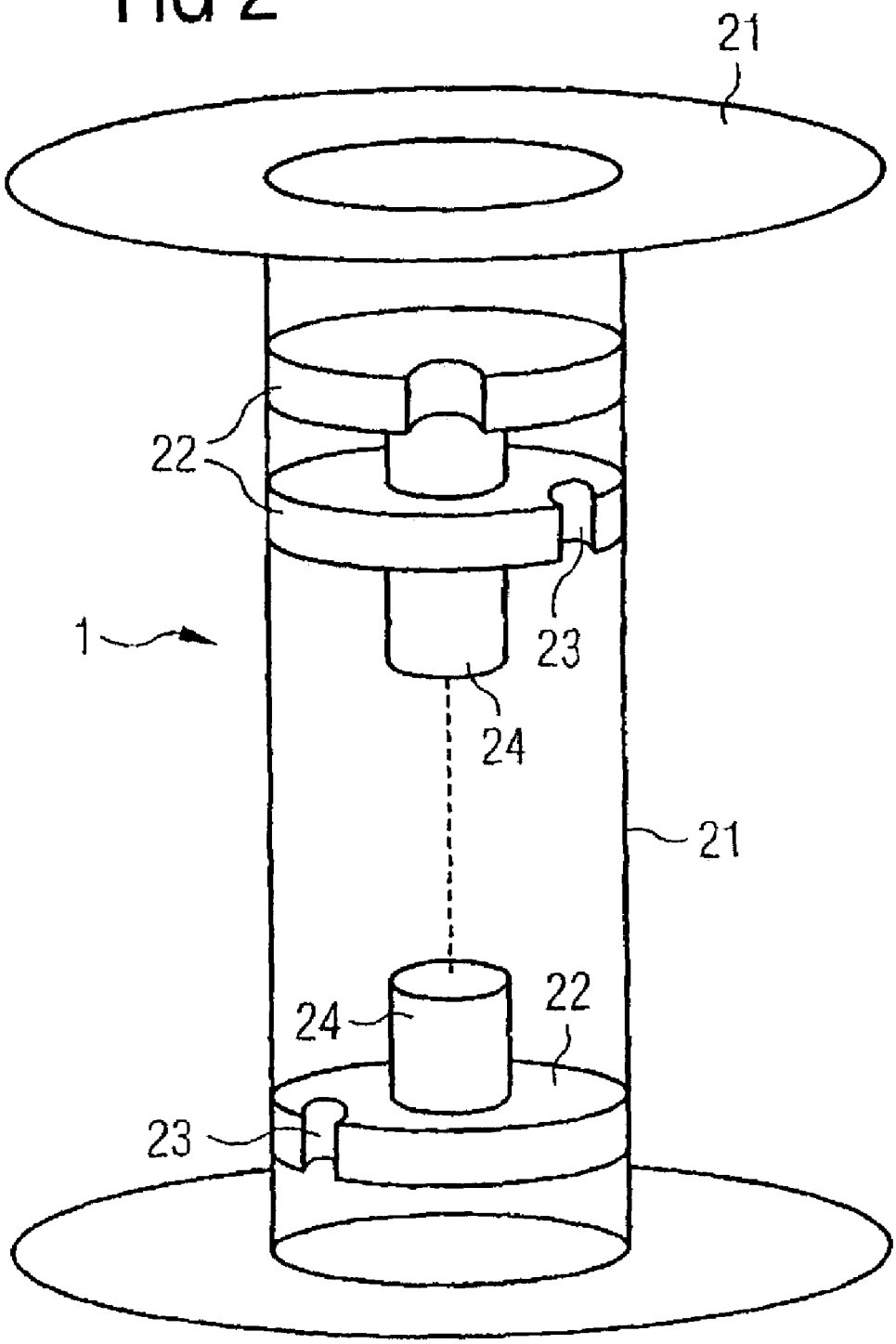
FIG. 2 An enlarged view, corresponding to FIG. 1, of a multistage inlet throttle of the accumulator injection device in accordance with the invention.

FIG. 2 shows an enlarged view of the multistage inlet throttle 19 of the accumulator injection device 1 according to the invention from FIG. 1. The multistage inlet throttle 19 is constructed from a number of throttle elements 22 that for example are arranged in a cylindrical housing 21. The two open ends of the housing 21 are the inlet and outlet openings of throttle 19. The throttle elements 21 in the example are disk-shaped and have throttle passages 23. In the illustrated embodiment, the throttle passage 23 is in the form of a recess or groove in the casing surface of the disk-shaped throttle element 22, with a defined flow cross-section of the throttle element 22 being obtained by the interaction of the groove with the inner casing surface of the cylindrical housing 21 when fitted in the housing. The passages or through openings can also be designed as through bores or other configurations of the throttle elements that narrow the cross-section. Spacers 24 that guarantee a minimum clearance between the throttle elements 22 are provided between the single throttle elements 22. The spacers 24 can be configured to be integral with the throttle elements 22 or can also be provided on the housing 21. The throttle elements 22 are preferably aligned in the cylindrical housing 21 in such a way that the respective passages 23 are offset relative to each other. This creates a throttling effect of a throttle element 22 that is largely independent with respect to the other throttle elements 22. The multistage throttle 19 shown in the exemplary embodiment is designed as a separate component and can be built into the same at low cost during the manufacture of the accumulator injection device 1 in accordance with the invention.

We claim:

1. Accumulator injection system comprising:

at least one high-pressure accumulator, a control chamber with a control piston, a valve, and an injection valve with a valve needle, with the injection valve being controlled by means of the control chamber and control piston, and the control chamber being connected to the high-pressure accumulator via an inlet throttle and also to the valve via an outlet throttle, wherein the inlet throttle is configured as a multistage throttle, wherein the multistage inlet throttle includes disk-shaped throttle elements with groove-shaped throttle passages, arranged in a housing in the manner of a series circuit.

2. Accumulator injection device in accordance with claim 1, wherein the inlet throttle is a cascade throttle.

3. Accumulator injection device in accordance with claim 1, wherein the multistage inlet throttle is constructed from a number of similar single throttles and/or throttle elements.

4. Accumulator injection device in accordance with claim 1, wherein the single throttles or throttle elements of the multistage inlet throttle are aligned relative to each other in such a way that their throttle passages are offset relative to each other.

5. Accumulator injection device in accordance with claim 1, wherein spacers are provided between the throttle elements.

6. Accumulator injection system comprising:

at least one high-pressure accumulator, a valve, a control chamber with a control piston, being connected to the high-pressure accumulator via a multistage inlet throttle and being connected to the valve via an outlet throttle, and an injection valve with a valve needle, controlled by the control chamber and the control piston, wherein the multistage inlet throttle includes disk-shaped throttle elements with groove-shaped throttle passages, arranged in a housing in the manner of a series circuit.

7. Accumulator injection device in accordance with claim 6, wherein the multistage inlet throttle is a cascade throttle.

8. Accumulator injection device in accordance with claim 6, wherein the multistage inlet throttle is constructed from a number of similar single throttles and/or throttle elements.

9. Accumulator injection device in accordance with claim 8, wherein the single throttles or throttle elements of the multistage inlet throttle are aligned relative to each other in such a way that their throttle passages are offset relative to each other.

10. Accumulator injection device in accordance with claim 1, wherein spacers are provided between the throttle elements.

11. Method of operating an accumulator injection system with at least one high-pressure accumulator, a valve, a control chamber with a control piston, and an injection valve with a valve needle, comprising the step of:

controlling the injection valve by the control chamber and the control piston through the high-pressure accumulator via a multistage inlet throttle between the high-pressure accumulator and the control chamber and an outlet throttle between the control chamber and the valve wherein the multistage inlet throttle includes disk-shaped throttle passages arranged in a housing in the manner of a series circuit.

12. The method as in claim 11, further comprising the step of constructing the multistage inlet throttle from a number of similar single throttles and/or throttle elements.

13. The method as in claim 11, further comprising the step of aligning the single throttles or throttle elements of the multistage inlet throttle relative to each other in such a way that their throttle passages are offset relative to each other.

* * * * *